United States Patent [19]

Nasby, Jr.

[11] Patent Number: 4,804,298

[45] Date of Patent: Feb. 14, 1989

[54] ANCHOR AND HINGE ARRANGEMENT FOR DOCKS

[75] Inventor: Charles L. Nasby, Jr., Minneapolis, Minn.

[73] Assignee: Span-Dock, Inc., Minneapolis, Minn.

[21] Appl. No.: 29,338

[22] Filed: Mar. 23, 1987

[51] Int. Cl.[4] ..... E02B 3/20

[52] U.S. Cl. ..... 405/218; 405/219; 405/220

[58] Field of Search ..... 405/218, 219, 220, 221; 114/263

[56] References Cited

U.S. PATENT DOCUMENTS

| | | | |
|---|---|---|---|
| 2,948,121 | 8/1960 | Karst | 405/220 |
| 3,004,391 | 10/1961 | Miller | 405/219 |
| 3,686,876 | 8/1972 | Muschell | 405/220 |
| 3,747,354 | 7/1973 | Macomber | 405/220 |
| 3,824,796 | 7/1974 | Nasby, Jr. | 405/220 |
| 4,589,800 | 5/1986 | Nasby, Jr. | 405/221 |
| 4,683,833 | 8/1987 | Meriwether | 405/220 X |

OTHER PUBLICATIONS

Span-Dock brochure printed in Jan. 1985, (6 pages).

Article on Span-Dock from Cook County News Herald, dated May 15, 1986, (1 page).

*Primary Examiner*—David H. Corbin

*Attorney, Agent, or Firm*—Merchant, Gould, Smith, Edell, Welter & Schmidt

[57] ABSTRACT

Disclosed is an anchoring pad (12) and hinge arrangement (45) for use with a dock structure (10) in a body of water (11). The concrete anchoring pad (12) includes a steel angle (44) and a reinforcing structure (40). A hinge (45) having a vertical and horizontal leaf (47, 46) interconnects the anchoring pad (12) to the dock structure (10) by a plurality of bolts (53, 54). Also disclosed is a chain support (56) for stabilization of the vertical support structure (29) of the dock (10).

13 Claims, 2 Drawing Sheets

ANCHOR AND HINGE ARRANGEMENT FOR DOCKS

FIELD OF THE INVENTION

The invention relates generally to an anchoring pad for the shore end of a dock structure and, more particularly relates to a concrete step which anchors a dock structure to the shoreline and which includes a hinge connection of the dock structure to the anchoring pad.

BACKGROUND OF THE INVENTION

Dock structures suitable for mooring small water craft and for use during swimming and other water-related recreational activities have long been produced. An example of such a dock structure is applicant's U.S. Pat. No. 3,824,796. An example of a method and apparatus for raising and lowering such a dock structure is disclosed in applicant's U.S. Pat. No. 4,589,800.

Often, the shore end of the dock simply sits on the ground itself. A portion of the bank may be dug out in order to provide a level space to position the end of the dock. The end of the dock may be supported with rocks or a concrete support base. Sometimes, the dock may be anchored to the underlying support base with a bolt or other rigid connection.

However, with typical shoreline dock supports, it is possible for the shore end of the dock to lift up, or for the dock structure to even tip. This can occur when there are heavy loads or several people at the outer end of the dock, or when the dock structure is overloaded at the point of the hinged connections linking adjacent dock sections.

Another problem with conventional shoreline dock supports is that the dock structure can become displaced from shore during a heavy storm or when subject to other strong forces. This, of course, results in substantial inconvenience and replacement expense for the owner.

Another difficulty with conventional shoreline dock supports is that they often lack stability and durability. If the dock sits on the shoreline itself, the underlying ground can become eroded. As a consequence, the dock is no longer level, or the dock must be periodically positioned at different points along the shoreline.

The present invention solves these and many other problems associated with currently available dock anchoring pads.

SUMMARY OF THE INVENTION

The present invention relates to an anchor and hinge arrangement for a dock structure. The anchor and hinge arrangement includes an anchoring pad, preferably made of concrete, positioned upon a shoreline adjacent the dock structure. A hinge interconnects the anchoring pad to the reinforcement structure of the dock so that the dock is securely positioned in the desired position adjacent the shoreline. The anchoring pad preferably includes a steel angle partially embedded in an upper portion of the concrete and reinforcing bars embedded therewithin. The hinge preferably includes a vertical and horizontal leaf, the vertical leaf being interconnected to the anchoring pad's steel angle by means of bolts embedded in and extending from the anchoring pad, and the horizontal leaf being interconnected to the dock's reinforcement structure. Another aspect of the invention is chain support means which stabilize the dock's underwater support structure.

The present invention is particularly advantageous in that it provides a sturdy shoreline anchoring pad for the dock structure. This prevents the dock from lifting off the shore or tipping when heavy loads are placed on the dock.

Another advantage of the present invention is that the anchoring pad maintains the proper position of the dock in the water. This alleviates the danger of accidental displacement of the dock during the act of mooring watercraft, during adverse weather conditions, or other extremities of use.

The present invention is also advantageous in that the dock can be easily removed from the water. The hinged connection of the present invention allows the dock to either be completely removed from the water or to be pivoted to an upright position on the shore. Either alternative involves a minimal amount of effort for the user.

Another feature of the present invention is that the anchoring pad provides a durable, safe step for people to get from the ground to the dock.

Another advantageous feature of the present invention is that it provides a level starting point which enables the entire length of the dock to maintain a level configuration.

A still further advantage of the present invention is that it can be sized and configured to be portable, especially when used in a relatively small body of water. If a more permanent anchoring pad is desired, or if the dock is being used in a large body of water, the concrete anchoring pad can be poured in place rather than precast to provide additional structural stability.

Yet another feature of the present invention is its stabilization of the dock's underwater support structure against the forces of rocks and boulders shifting on the bottom of the lake.

For a better understanding of the invention, and of the advantages attained by its use, reference should be had to the drawings and accompanying descriptive matter, in which there is illustrated and described a preferred embodiment of the invention.

BRIEF DESCRIPTION OF THE DRAWINGS

Referring particularly to the drawings wherein like reference numerals indicate like parts throughout the several views.

DESCRIPTION OF THE PREFERRED EMBODIMENT

Figure 1:
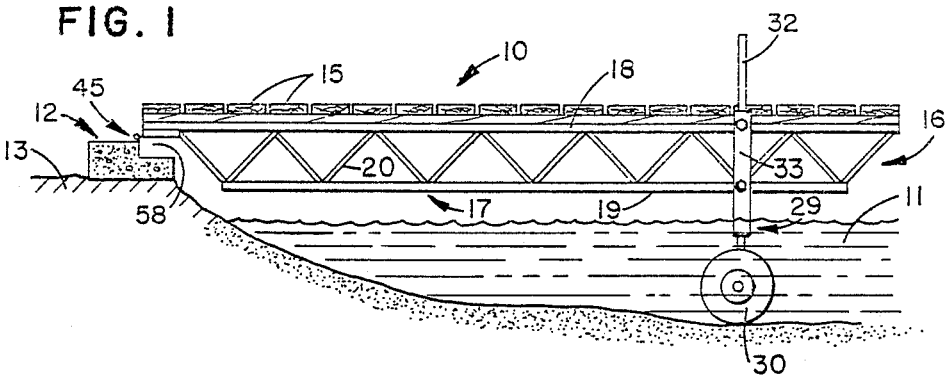
FIG. 1 is a side elevational view of the anchor and hinge arrangement of the present invention in operative placement with a dock.
Figure 2:
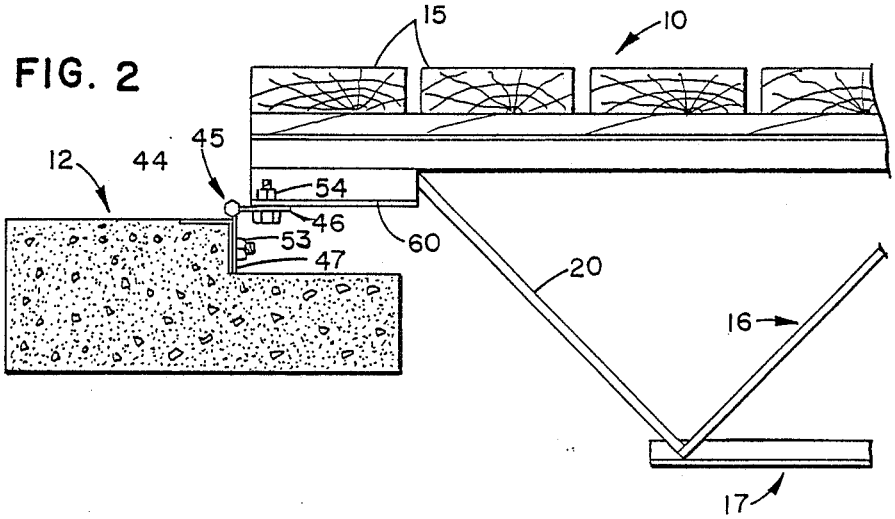
FIG. 2 is an enlarged side elevational view of the anchor and hinge arrangement shown in FIG. 1.

Referring now to the drawings, illustrated in FIGS. 1 and 2 is a preferred embodiment of the anchoring pad of the present invention, designated generally by the numeral 12. The anchoring pad 12 is situated adjacent the shoreline 13 of a body of water 11. The anchoring pad 12 may either sit on top of the shoreline 13, as shown, or be situated against a bank on the shoreline 13. The anchoring pad 12 is operatively connected to a dock structure 10 which extends into a body of water 11. FIG. 1 illustrates a single dock structure, but it is to be understood that multiple dock sections interconnected to one another, or dock structures of different shapes, could also be utilized with the present invention.

In the embodiment shown, a deck structure 15 of the dock 10 includes a reinforcement structure 16. The deck structure 15 includes a wooden deck secured to the reinforcement structure 16 by bolts or the like. The reinforcement structure 16 includes a pair of longitudinally extending bar joists 17. The bar joists 17 are truss-type supporting structures, and each includes an upper chord element formed of longitudinally extending laterally spaced rail members 18, a lower chord element formed of laterally spaced rail members 19 and angularly exposed connecting elements 20. The supporting structure 16 is extremely rigid to withstand those lateral and vertical forces, as well as twisting forces on a longitudinal axis.

In the preferred embodiment of the dock structure 10 shown in FIG. 1, a wheel-equipped support structure 29 supports one end of the dock structure 10. The wheel-equipped support structure 29 includes a pair of wheels 30 pivotally mounted on a transversely extending axle (not shown). The wheel-equipped support structure 29 is preferably spaced from the outer end of the dock structure 10 to provide a cantilevered outer end portion to permit use of the outer end of the dock structure 10 with a minimum of underwater obstacles. However, the support structure 29 for the dock structure 10 might not be wheel-equipped, but rather might have suitable platform supports instead of wheels.

Each support structure 29 includes an elongated upright support member 32. Each elongated upright support member 32 is telescopically received within one of a pair of sleeve-like tubular members 33 to permit vertical adjustment of wheels 30. This is described in detail in Applicant's U.S. Pat. No. 4,589,800.

Preferably, the anchoring pad 12 of the present invention is made of concrete. As shown in the drawings, the anchoring pad or concrete step 12 is substantially rectangular with a notched portion 58. Preferably, the notched portion 58 is located on the upper corner of the anchoring pad 12, on the end proximate the dock structure 10 and extends longitudinally of the anchoring pad 12. In the preferred embodiment shown, the anchoring pad 12 is approximately five and one-half ($5\frac{1}{2}$) inches tall at the end farthest from the dock, and approximately three and one-half ($3\frac{1}{2}$) inches tall at the notched portion 58 closest to the body of water. The anchoring pad 12 is preferably approximately three (3) feet long in the direction transverse to the length of the dock. The width of the anchoring pad is a total of fourteen (14) inches, with the width of the notched portion 58 being approximately six (6) inches. With these dimensions, the concrete anchoring pad 12 can be precast and weighs approximately one-hundred eighty (180) pounds. This size and weight enables the anchoring pad 12 to be relatively portable.

If desired, a larger concrete step anchoring pad 12 (not shown) can be provided. The concrete could be poured in place at the desired location adjacent the shoreline. A larger anchoring pad is often desirable for larger bodies of water, and could weigh over five-hundred (500) pounds. Many configurations of a poured-in-place concrete anchoring pad are possible, but with the larger size anchoring pad, it is desirable to have the center of gravity of the anchoring pad be closer inshore than the configuration shown in the drawings. This can be achieved by providing a symmetrical anchoring pad with notched portions on each end. Alternately, the larger anchoring pad's configuration could be the reverse of that shown in the drawings, with the notched portion 58 facing away from the dock.

Figure 4:
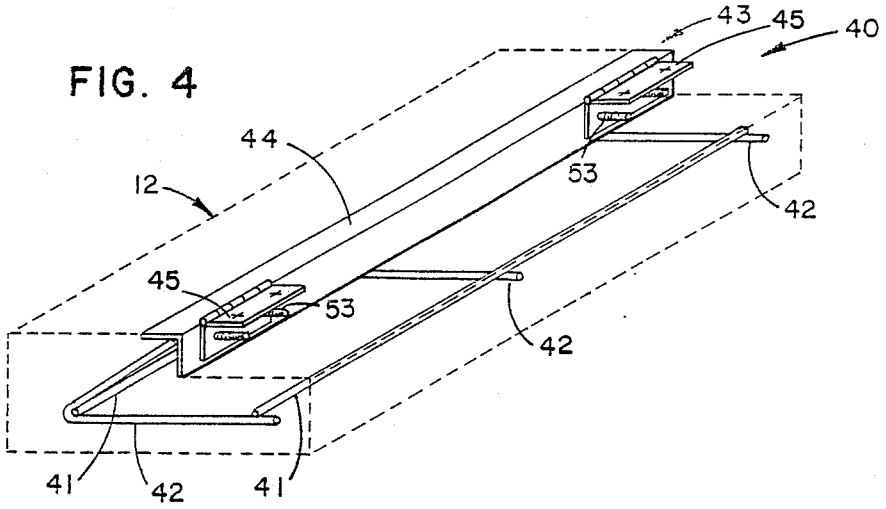
FIG. 4 is a perspective view of the interior support structure for the anchoring pad of the present invention.

FIG. 4 illustrates an interior support structure 40 for the anchoring pad 12 (shown in phantom) of the present invention. It includes two (2) horizontal reinforcing rods 41, and three bent reinforcing rods 42 which are welded to rods 41. In the preferred embodiment, the rods 41 and 42 are #4 reinforcing rods.

FIG. 4 also illustrates the steel angle assembly 43 which enables connection of the anchoring pad 12 to the dock structure 10. The steel angle assembly 43 includes a steel angle 44. The steel angle 44 is embedded in the concrete anchoring pad 12. With the preferred size of the anchoring pad 12 noted above, the preferred size of the angle 44 is two (2) inches by two (2) inches by one-eighth ($\frac{1}{8}$) inch steel angle, three (3) feet long. Preferably, the upper end of the bent reinforcing rods 42 extends into the inner corner of the steel angle 44 for additional structural stability.

Figure 3:
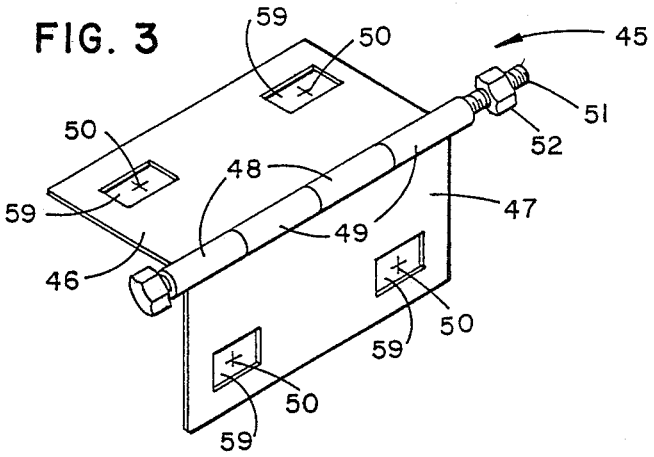
FIG. 3 is a perspective view of the hinge connection of the present invention.

A hinge 45 is provided for a hinged connection of the anchoring pad 12 to the dock structure 10. The hinge 45, best shown in FIGS. 2 and 3, comprises a horizontal leaf 46 and a vertical leaf 47. The hinge 45 also has a hollow "pipe" or cylinder section, portions 48 of which are welded to the horizontal leaf 46 and portions 49 of which are welded to the vertical leaf 47. Preferably, the inside diameter of the hollow cylindrical portions 48 and 49 is approximately one-quarter ($\frac{1}{4}$) inch. Preferably, the dimensions of the horizontal 46 and vertical 47 leaves are two (2) inches by four (4) inches. The hinge is preferably made of steel, three-sixteenths (3/16) inch thick. The horizontal 46 and vertical 47 leaves each contain two slotted holes or apertures 50 with plastic inserts 59. Bolts 53 on the anchoring pad 12 are inserted within the slotted holes or apertures 50, and plastic inserts 59 are preferably provided in order to "thumb" tighten the bolts. A removable pin 51 is inserted within the hollow cylindrical portions 48 and 49. The pin 51 may be a hex-head machine bolt. The pin 51 is secured at one end by a nut 52 or other suitable connection. The pin 51 is preferably about five-sixteenths (5/16) inch in diameter and five (5) inches long.

The vertical leaf 47 of the hinge 45 is positioned to be flush with the vertical portion of the steel angle 44. Bolts 53 in the steel angle 44 extend through the slotted holes 50 in the vertical leaf 47 and thereby operatively connect the steel angle 44 of the anchoring pad 12 to the hinge 45 of the dock structure 10. There are preferably two hinges 45 for each three (3) foot long concrete anchoring pad 12, and two (2) bolts 53 per hinge 45. The horizontal leaf 46 is positioned flush with the underside of a horizontal support plate 60 of the dock reinforcing structure 16. Bolts or other suitable connectors 54 are inserted through the slotted holes 50 of the horizontal leaf 45 to operatively connect the hinge 45 to the dock structure 10.

The pin 51 of the hinge 45 is easily removable to allow displacement of the dock structure 10 from the anchoring pad 12 in order to remove the dock structure from the body of water 11. The dock can then be removed from the water by using a winch, as explained in Applicant's U.S. Pat. No. 4,589,800. Alternatively, the dock 10 can be pivoted about the hinge 45 to an upright position during the months when the dock 10 is not in use, which eliminates the necessity of completely removing the dock 10 from the water 11. The hinged connection 45 also allows for vertical adjustment of the dock 10, depending on the contour of the land underlying the water 11. This is particularly useful when there are several adjacent sections of dock 10.

Figure 5:
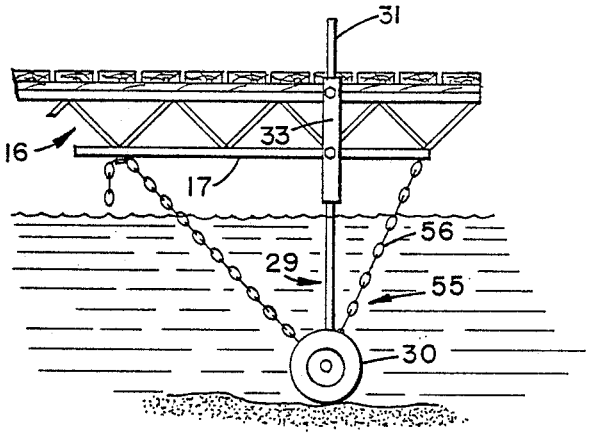
FIG. 5 is a side elevational view of the chain support of the present invention.
Figure 6:
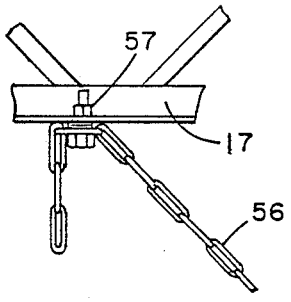
FIG. 6 is an enlarged side elevation view of the connection of the chain support shown in FIG. 5 with the reinforcement structure of the dock.

Another aspect of the present invention is a chain support 55 for the upright support structure 29. The chain support 55 includes a chain 56 which is operatively connected to the dock supporting structure 16 and to the axle (not shown) of the support structure's wheel 30. Preferably, the chain 56 is wond around the axle twice. The connection of the chain 56 to the bottom angle of the steel joist 17 of the dock supporting structure 16 is illustrated in FIG. 6. A bolt or other suitable connection 57 is provided. The chain in then "winched" taut, to a position shown in FIG. 5. Preferably, the tires 30 are filled with concrete. Thus, the concrete tires 30, the chain support 55, and the hinged connection 45 to the concrete anchoring pad 12 enable the dock 10 to perform under adverse conditions. These three features also act to offset the forces of the movement of boulders on the lake bottom.

Even though numerous characteristics and advantages of the invention have been set forth in the foregoing description, together with details of the structure and function of the invention, the disclosure is illustrative only, and changes may be made in detail, especially matters of shape, size and arrangement of parts, within the principles of the invention, to the full extent indicated by the broad general meaning of the appended claims.

I claim:

1. An anchor and hinge arrangement for a dock structure, comprising:

(a) a concrete anchoring pad positioned upon a shoreline adjacent said dock, said anchoring pad including a steel angle partially embedded therewithin in an upper portion of said anchoring pad; and (b) a steel hinge including a vertical and horizontal leaf interconnected by pivotable means therebetween, said vertical leaf being operatively connected to said steel angle in said anchoring pad, and said horizontal leaf being operatively connected to a reinforcement structure of said dock, whereby said dock is securely positioned in a body of water.

2. The anchor and hinge arrangement according to claim 1, wherein said anchoring pad is substantially rectangular and includes an upper longitudinal notched portion on the end of said anchoring pad proximate said body of water.

3. The anchor and hinge arrangement according to claim 1, wherein said anchoring pad includes steel reinforcing bars therewithin for structural support.

4. The anchor and hinge arrangement according to claim 1, wherein two hinges interconnect said anchoring pad to said dock structure.

5. The anchor and hinge arrangement according to claim 1, wherein a plurality of bolts are partially embedded in said anchoring pad and extend through apertures in a vertical position of said steel angle so as to operatively connect said anchoring pad to said vertical leaf of said hinge.

6. The anchor and hinge arrangement according to claim 1, further comprising chain support means to stabilize an underwater support structure of said dock.

7. An anchor and hinge arrangement for a dock of the type having a reinforcement structure, comprising:

(a) a substantially rectangular concrete anchoring pad positioned upon a shoreline adjacent said dock, said anchoring pad including steel reinforcing bars embedded therewithin and a steel angle partially embedded therewithin in an upper portion of said anchoring pad and proximate said dock, said anchoring pad further including a plurality of horizontal bolts partially embedded therewithin and extending through apertures in a vertical portion of said steel angle; and (b) at least one steel hinge including a vertical and horizontal leaf with pivotable means therebetween, wherein said horizontal bolts extending from said anchoring pad operatively connect said anchoring pad to said vertical leaf of said hinge, and vertical bolts operatively connect a horizontal support plate on said reinforcement structure of said dock to said horizontal leaf of said hinge, whereby said dock is securely positioned in a body of water.

8. An apparatus for anchoring a dock structure to a shoreline of a body of water, comprising:

(a) an anchoring pad positioned proximate the shoreline, said anchoring pad including a plurality of first bolts, one end of said first bolts being embedded in said concrete, an opposite end of said first bolts extending outwardly from said anchoring pad;

(b) a plate on said dock structure, said plate including a plurality of apertures sized and configured to receive a plurality of second bolts; and (c) a hinge having a first leaf and a second leaf, each of said leaves having a plurality of apertures, said apertures in said first leaf being sized and configured to receive said first bolts and to secure said first leaf to said anchoring pad, said apertures in said second leaf being sized and configured to receive said second bolts and to secure said second leaf to said dock structure so as to prevent movement of said dock structure within the body of water.

9. The apparatus for anchoring a dock structure according to claim 8, wherein said hinge is pivotable so as to permit the position of said dock structure to be raised or lowered when desired.

10. The apparatus for anchoring a dock structure according to claim 9, wherein said anchoring pad is made of concrete.

11. The apparatus for anchoring a dock structure according to claim 10, wherein said anchoring pad is positioned upon the shoreline, said anchoring pad being of sufficient weight relative to said dock structure so as to prevent movement of said dock structure within the body of water.

12. The apparatus for anchoring a dock structure according to claim 9, wherein said anchoring pad includes steel reinforcing members therewithin for structural support.

13. The apparatus for anchoring a dock structure according to claim 9, further comprising chain support means, said chain support means interconnecting an upper support member of said dock structure with a bottom end of a vertical support member of said dock structure.

* * * * *